US006179646B1

(12) United States Patent
Horchler

(10) Patent No.: US 6,179,646 B1
(45) **Date of Patent: *Jan. 30, 2001**

(54) CABLE CLAMP ASSEMBLY

(75) Inventor: David C. Horchler, Millersburg, PA (US)

(73) Assignee: Berg Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/963,677

(22) Filed: Oct. 31, 1997

(51) Int. Cl.[7] ..... H01R 13/00
(52) U.S. Cl. ..... 439/460; 439/470
(58) Field of Search ..... 174/65 G, 65 SS; 439/445–473; 16/2

(56) References Cited

U.S. PATENT DOCUMENTS

| | | | | |
|---|---|---|---|---|
| 3,189,962 | | 6/1965 | Hartwell . | |
| 3,861,778 | | 1/1975 | Capra . | |
| 3,966,292 | * | 6/1976 | Schultz | 439/445 |
| 4,299,363 | * | 11/1981 | Datschefski | 174/65 G |
| 4,310,213 | | 1/1982 | Fetterolf et al. . | |
| 4,513,172 | * | 4/1985 | Matsui | 174/65 SS |
| 5,350,204 | * | 9/1994 | Henniger | 285/33 |
| 5,374,017 | | 12/1994 | Martin et al. . | |
| 5,460,540 | * | 10/1995 | Reichle | 439/445 |

FOREIGN PATENT DOCUMENTS

| | | | | |
|---|---|---|---|---|
| 2517826 | * | 6/1975 | (DE) | 174/65 SS |
| 75 12311 | | 4/1975 | (FR) . | |
| 76 37769 | | 12/1976 | (FR) . | |
| 1 487 554 | | 10/1973 | (GB) . | |
| 2 019 131 | | 10/1979 | (GB) . | |

* cited by examiner

*Primary Examiner*—Lincoln Donovan
(74) *Attorney, Agent, or Firm*—Brian J. Hamilla; M. Richard Page

(57) ABSTRACT

A cable clamp assembly which is adapted for use with a range of cable diameters. The assembly includes a tubular base section, a first finger extending axially from the tubular base section and having a cable engagement projection and a second finger extending axially from the tubular base section and having a cable engagement projection. The assembly also provides flex relief and strain relief at any adjacent crimp to wire or solder to wire interconnections.

15 Claims, 2 Drawing Sheets

CABLE CLAMP ASSEMBLY

BACKGROUND OF THE INVENTION

1. Field of the Invention

The present invention relates to electrical connectors and more particularly to clamps for securing electrical cables in electrical connectors.

2. Brief Description of Prior Developments

Various devices have been suggested for holding an electrical cable within an electrical connector. One disadvantage to such devices has been that ordinarily design to accommodate only one size and a narrow range of sizes of electrical cable. There is, therefore, a need for cable clamp assembly which accommodates a wide range of cable sizes and is easy to use and economical to manufacture. There is also a need for such a device which provides strain relief and flex relief for the crimp to wire or solder to wire interconnections.

SUMMARY OF THE INVENTION

The present invention is a cable clamp assembly which is adapted for use with a range of cable diameters. The assembly includes a tubular base section, a first finger extending axially from the tubular base section and having a cable engagement means and a second finger extending axially from the tubular base section and having a cable engagement means. This assembly accommodates a variety of cable diameters and also provides flex relief and strain relief at any adjacent crimp to wire or solder to wire interconnections.

BRIEF DESCRIPTION OF THE DRAWINGS

The invention is further described with reference to the accompanying drawings in which.

DETAILED DESCRIPTION OF THE PREFERRED EMBODIMENTS

Figure 2:
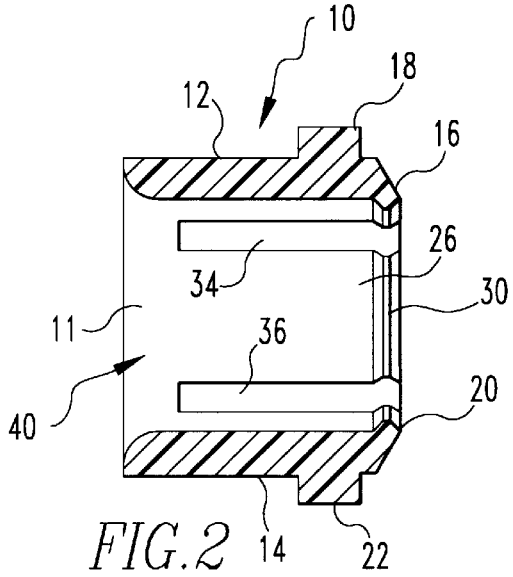
FIG. 2 is a vertical cross sectional view through 2—2 in FIG. 1.
Figure 1:
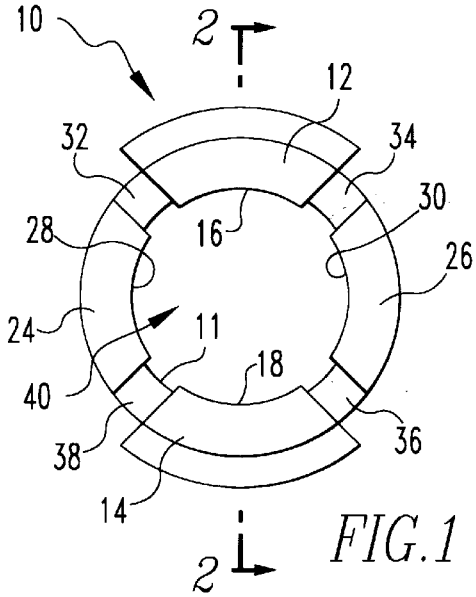
FIG. 1 is a front elevational view of a preferred embodiment of a cable clamp bushing of the present invention.

Referring to FIGS. 1–2, the cable clamp bushing shown generally at numeral 10 includes a tubular base section 11 and a resilient first finger 12 and a resilient second finger 14 which is positioned in opposed relation to said first finger with respect to the tubular base section. The first finger 12 has a terminal projection 16 which extends in a forward and inward direction. The first finger also has an outward radial projection which is positioned rearwardly from its forward terminal end. The second finger has a terminal projection 20 which extends in a forward and inward direction. The second finger also has an outward radial projection 22. A resilient third finger 24 and a resilient fourth finger 26 also extend from the tubular base section 11. The third finger has a terminal inward and forward projection 28. The fourth finger 26 has a terminal inward and forward projection 30. Between the first finger 12 and the third finger 24 there is an axial groove 32. Between the first finger 12 and the fourth 26 there is an axial groove 34. Between the second finger 14 and the fourth finger 26 there is an axial groove 36. Between the second finger 14 and the third finger 24 there is an axial groove 38. The bushing 10 also has an axial bore 40 for receiving a cable. The rearward edge 41 of the bushing 10 is also rounded to accommodate cable flex as explained further hereafter.

Figure 3:
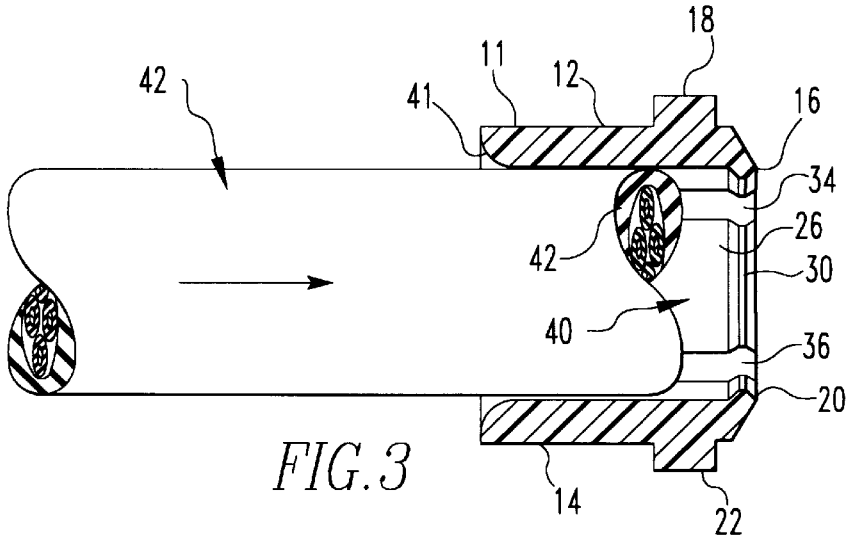
FIG. 3 is a vertical cross sectional view of the bushing shown in FIG. 2 showing this initial engagement with a cable.
Figure 4:
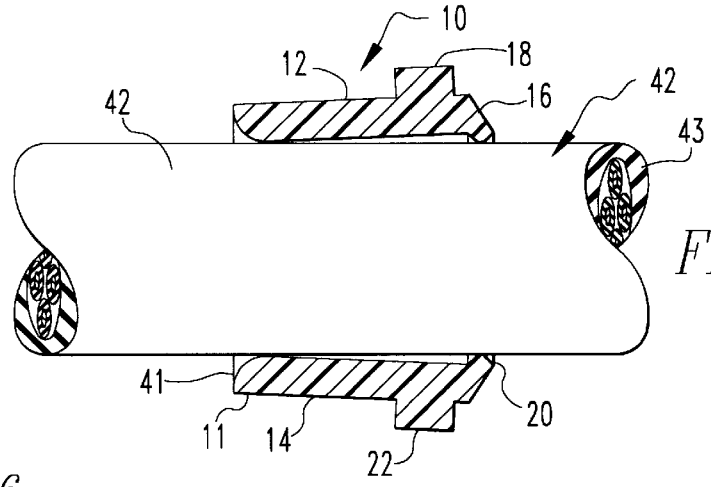
FIG. 4 is a view similar to FIG. 3 showing the engaged cable.

Referring to FIG. 3, the insertion of a cable shown generally at numeral 42 in this axial bore 40 is illustrated. Referring to FIG. 4, as the cable moves axially forward the fingers as at finger 12 and finger 14 flex to expand to accommodate the cable's diameter. The inward and forward projections of the fingers as at projections 16 and 20, grip the outer insulative jacket of the cable. It will be understood, that although fingers 24 and 26 are not shown in FIG. 4, that these fingers also flex to expand to accommodate the cable's diameter. It will be also understood that their inward and forward projections 28 and 30 grip the outer insulative jacket 43 of the cable 42. Those skilled in the art will appreciate that the fingers will flex to a greater degree to accommodate a cable of a larger diameter and will flex to a smaller degree to accommodate a cable of a smaller diameter.

Figure 5:
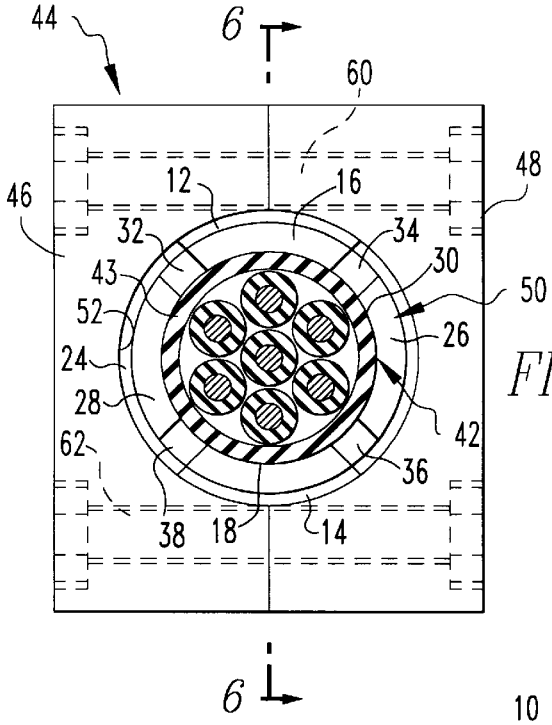
FIG. 5 is a front elevational view of the cable clamp bushing shown in FIG. 1 mounted in an electrical shell.
Figure 6:
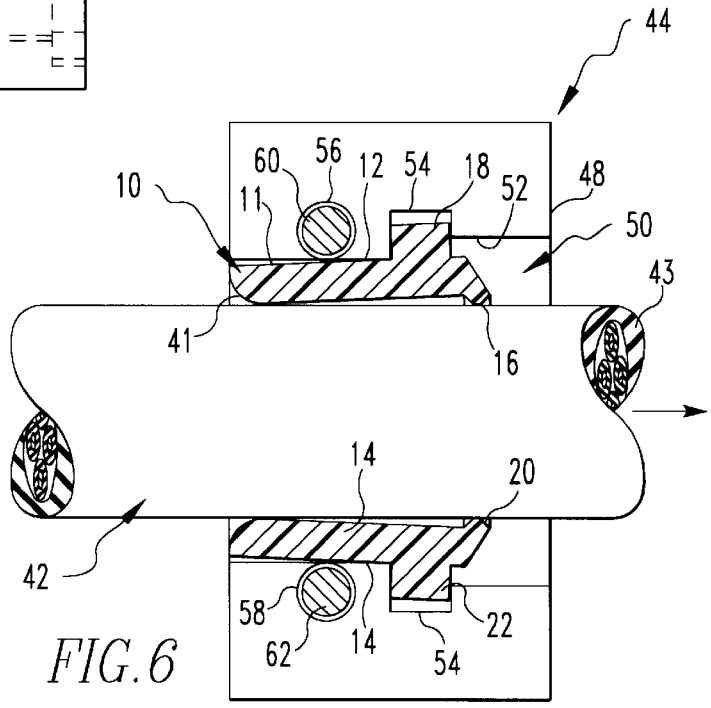
FIG. 6 is a cross sectional view of the assembly shown in FIG. 5 through 6—6 shown with an engaged cable.

Referring to FIGS. 5–6, the bushing is enclosed within a machined metal connector shell shown generally at numeral 44. This shell is bifurcated into a first opposed section 46 and a second opposed section 48. The connector shell also has a central opening 50 for housing the bushing. Adjacent the central opening 50, the shell 44 has a cylindrical inner wall 52 with a peripheral groove 54. Referring particularly to FIG. 6, it will be seen that the peripheral groove receives the outward radial projection 18 of the first finger 12 and the outward radial projection 22 of the second finger 14. The inward and forward projections on the fingers grip the outer insulative jacket 43 of the cable 42 to cause resistance to forces that would pull the cable out of the connector shell 44. The connector shell 44 includes an upper transverse aperture 56 and a lower transverse aperture 58 which receive, respectively, clamping bolt 60 and clamping bolt 62 which fix the first opposed section 46 and the second opposed section 48 of the shell 44 together.

It will be appreciated that a cable clamp assembly has been described which allows a single assembly to be used for mounting a variety of different cable diameters in an electrical connector. Relatively smaller differences in diameter can be accommodated by having the fingers flex radially outwardly or inwardly. Larger differences in diameter can be accommodated by removing the bushing 10 from the shell and replacing the original bushing with another bushing. Those skilled in the art will readily appreciate that it would be feasible to manufacture a number of bushings having different sizes of central bores which would have a uniform outer dimension that would fit the inner wall 52 and peripheral groove 54 of the shell 44. It will also be appreciated that providing a variety of bushings would ordinarily be economically advantageous as compared with providing a similar variety of different sizes of connector shells.

It will also be appreciated that this assembly provided flex relief and strain relief for any crimp to wire or solder to wire interconnections which may be made to the cable. The rounded surface on the rear end 41 of the bushing allows such flex relief. Referring particularly to FIG. 6, it will be seen that if there is a crimp to wire or solder to wire interconnection on the cable in the direction of the arrow, the cable would tend to be pulled in that direction. Such strain on the interconnection would, therefore, tend to tighten the projections 16 and 20 on the outer insulative jacket 43 of the cable 42 and thereby tend to relieve strain on the interconnection.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector comprising:

an outer peripheral shell; and a cable clamp assembly sized and shaped for receipt in the outer peripheral shell, the cable clamp assembly comprising, (a) a tubular base section having a central bore;

(b) a resilient elongated first finger extending axially from the tubular base section and having an outward radial projection and an inwardly extending projection for engaging a cable inserted into the clamp assembly; and (c) a resilient elongated second finger extending axially from the tubular base section and having an outward radial projection and an inwardly extending projection for engaging the cable, wherein said outward radial projections define an outermost diameter of said cable clamp assembly, so that said cable clamp assembly is retained in the outer peripheral shell by the outward radial projections of the first and second fingers which engage a recess in the outer peripheral shell, and wherein said cable clamp assembly is mountable on a variety of cables having different diameters passing through the central bore of the tubular base, such that said different diameters are accommodated by the fingers flexing radially outwardly or inwardly.

2. The cable clamp assembly of claim 1 wherein the second finger is positioned in axial opposed relation to the first finger.

3. The cable clamp assembly of claim 2 further comprising opposed third and fourth fingers peripherally interposed between said first and second fingers.

4. The cable clamp assembly of claim 3 wherein there are axial enlongated recesses between adjacent fingers.

5. The cable clamp assembly of claim 1 wherein the inwardly extending projections also extend forwardly from the first and second fingers.

6. The cable clamp assembly of claim 5 wherein there are axial enlongated recesses between adjacent fingers.

7. The cable clamp assembly of claim 1 wherein the inner recess in the peripheral shell comprises an inner peripheral groove.

8. The cable clamp assembly of claim 7 wherein the peripheral shell has a central base in which the tubular base section and axial fingers are mounted.

9. The cable clamp assembly of claim 8 wherein the peripheral shell is bifurcated into opposed first and second sections.

10. The cable clamp assembly of claim 9 further comprising a fastener to retain the first and second sections of the peripheral shell in opposed relation.

11. The cable clamp assembly of claim 6 wherein said assembly has a central bore and is concentrically mounted on a cable.

12. The cable assembly of claim 1 wherein the tubular base section has a rear edge which is rounded.

13. A cable clamp assembly comprising:

(a) a first replaceable bushing having a tubular base section, a plurality of elongated resilient axial fingers each having a terminal inward projection and an outward radial projection, and a central axial bore; and (b) an outer shell having a central axial opening and an inner wall with a peripheral groove and peripherally surrounding the tubular base section such that the peripheral groove axially restrains the radial projections of the first bushing while allowing radial movement of said radial projections, and said outer shell has a first and a second element which may be disassembled then reassembled to allow replacement of the first bushing;

wherein said cable clamp assembly alternatively accepts a first electrical cable having a first cable diameter positioned in the central axial bore of the first bushing, or a second electrical cable having a second cable diameter different from said first cable diameter, said second electrical cable being accepted by flexing the fingers of the first bushing inwardly or outwardly, or by replacing the first bushing with a second replaceable bushing having a tubular base, a plurality of elongated resilient axial fingers each having a terminal inward projection and an outward radial projection, and a central axial bore having a second bore diameter wherein said second bore diameter is different from said first bore diameter.

14. A cable clamp assembly for engaging an electrical cable, comprising:

a bushing having:

a tubular base with a central axial bore; and a plurality of elongated resilient axial fingers, each having a terminal inward projection and an outward radial projection; and an outer shell, having:

a central axial opening; and an inner wall with a peripheral groove and peripherally surrounding the tubular base section such that the peripheral groove axially restrains the radial projections of the tubular base section while allowing radial movement of said radial projections to accommodate electrical cables of various dimensions;

wherein said outer shell has a first and a second element which may be disassembled then reassembled to allow replacement of the first bushing.

15. The cable clamp assembly as recited in claim 14, further comprising a fastener securing said first element and said second element together, said fastener oriented transverse to the electrical cable.

* * * * *